US005362007A

United States Patent [19]

Raasch

[11] Patent Number: 5,362,007

[45] Date of Patent: Nov. 8, 1994

[54] APPARATUS FOR FORMING A YARN RESERVE

[75] Inventor: Hans Raasch, Mönchengladbach, Germany

[73] Assignee: W. Schlafhorst AG & Co., Moenchengladbach, Germany

[21] Appl. No.: 11,964

[22] Filed: Feb. 1, 1993

[30] Foreign Application Priority Data

Feb. 1, 1992 [DE] Germany ..... 4202962

[51] Int. Cl.[5] ..... B65H 54/02

[52] U.S. Cl. ..... 242/18 OEW; 242/165

[58] Field of Search ..... 242/18 EW, 18 PW, 18 R, 242/164, 165

[56] References Cited

U.S. PATENT DOCUMENTS

| | | | |
|---|---|---|---|
| 4,736,898 | 4/1988 | Raasoli | 242/18 EW |
| 5,056,723 | 10/1991 | Inoue | 242/18 EW |
| 5,133,514 | 7/1992 | Inoue | 242/18 EW |

FOREIGN PATENT DOCUMENTS

| | | |
|---|---|---|
| 1760243 | 8/1972 | Germany . |
| 3602574 | 7/1987 | Germany . |
| 4008001 | 9/1990 | Germany . |
| 60-112569 | 6/1985 | Japan . |
| 2209370 | 8/1990 | Japan . |
| 359641 | 2/1962 | Switzerland . |

*Primary Examiner*—Stanley N. Gilreath

*Attorney, Agent, or Firm*—Herbert L. Lerner; Laurence A. Greenberg

[57] ABSTRACT

A textile machine producing cross-wound bobbins or cheeses includes a number of work stations having a creel with a bobbin changing position for holding a yarn package having an outer surface and an end surface and being disposed on a tube having an end, and a movable servicing device serving the work stations for changing takeup bobbins and having a drive apparatus for a bobbin in the changing position and a yarn suction device for seeking, aspirating and pulling off a yarn end that has run up onto the outer surface of the yarn package. An apparatus for forming a yarn reserve on a bobbin at a winding station includes a yarn guide element being disposed on the creel and movable toward and away from the bobbin for clasping the tube over a sector of at least 90° in the circumferential direction of the tube and winding the yarn end on the end of the tube to make a yarn reserve. The yarn guide element has a yarn guide surface to be placed against the end face of the yarn package. The yarn guide surface has a yarn catching notch formed therein immediately adjacent the end face of the yarn package. An actuating element actuates the yarn guide element.

3 Claims, 3 Drawing Sheets

FIG.1
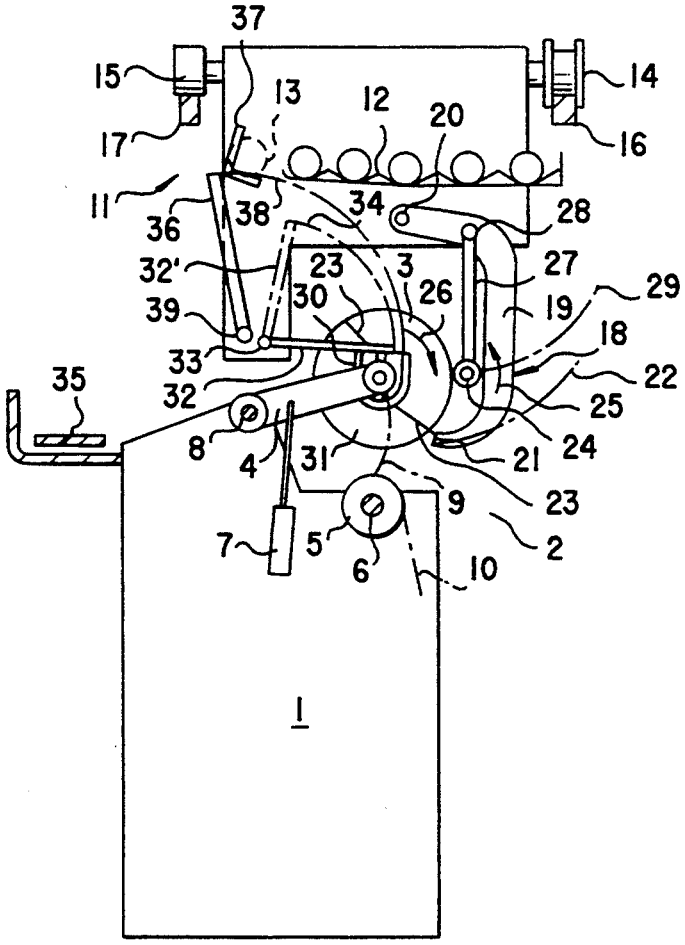
FIG.6
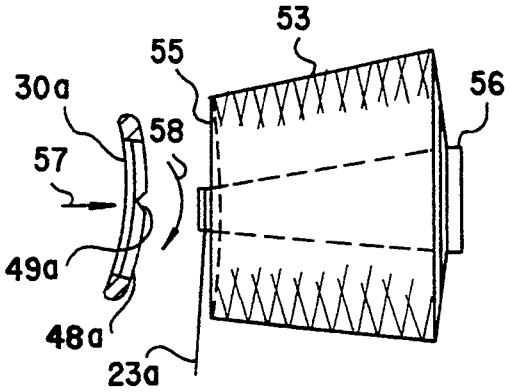
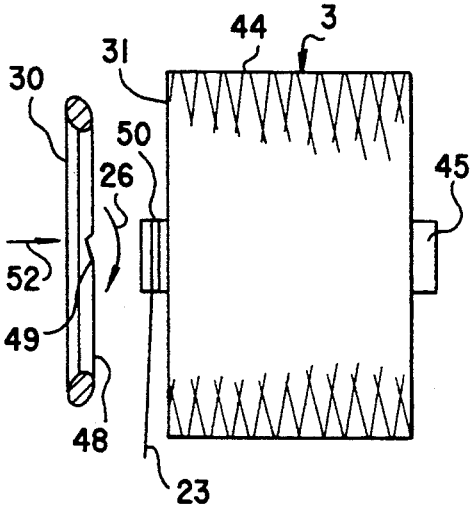
FIG.5
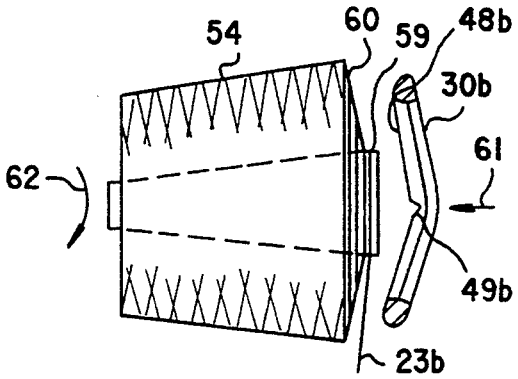
FIG.7

APPARATUS FOR FORMING A YARN RESERVE

The invention relates to an apparatus for forming a yarn reserve on bobbins at winding stations of a textile machine that produces cross-wound bobbins or cheeses, including a number of work stations and a movable servicing device serving the work stations, being disposed for changing takeup bobbins and having a drive apparatus for the bobbins located in a changing position and a yarn suction device for seeking, aspirating and pulling off a yarn end that has run up onto the surface of the bobbins, wherein the yarn end is wound on the end of a the to make a yarn reserve with the aid of a yarn guide element that is located on the creel and is movable toward and away from the bobbin.

In order to make it easier to find the end of a yarn when winding bobbins, it is known to wind the yarn end onto one of the ends of the tube, as a reserve or end reserve. The yarn reserve makes it easier to find the yarn end and to draw off a certain yarn length, in order to thread the end of the yarn into whichever device is further processing it.

From German Published, Non-Prosecuted Application DE 36 02 574 A, corresponding to U.S. Pat. No. 4,736,898, a yarn guide element is known that is supported on a creel and is movable toward and away from the bobbin. The yarn guide element is pivotable about a pivot point on the creel and can be kept in a position of repose under the influence of a spring, for instance. If an end reserve is to be wound, a shift lever presses the yarn guide element with its yarn guide contour into the vicinity of a nip formed between the yarn package and the tube of the bobbin. The yarn traveling along an end surface of the bobbin to the yarn suction device is engaged by the yarn guide contour and winds onto the tube. As long as the yarn is still taut between the tube and the yarn suction device due to the suction being applied, the yarn also winds onto the tube in firm turns.

However, as soon as the yarn end leaves the yarn suction device, the yarn becomes slack. The yarn guide contour can still carry the yarn end to the tube, but the remaining windings and in particular the last one, remain slack because of the absence of tension acting upon the yarn.

The last yarn windings on the tube can easily drop off or be pulled off, as a result. The yarn end can become loose again and catch on transport means, particularly when bobbins are transported automatically. The result is dragging yarns and the resettle may be pulled off entirely or the bobbin may become stuck and block the transport system.

It is accordingly an object of the invention to provide an apparatus for forming a yarn reserve, which overcomes the hereinafore-mentioned disadvantages of the heretofore-known devices of this general type and which forms a yarn reserve that is secured optimally against becoming loose.

With the foregoing and other objects in view there is provided, in accordance with the invention, in a textile machine producing cross-wound bobbins, including a number of work stations having a creel with a bobbin changing position for holding a bobbin having an outer surface and an end surface and being disposed on a tube having an end, and a movable servicing device serving the work stations for changing takeup bobbins and having a drive apparatus for a bobbin in the changing position and a yarn suction device for seeking, aspirating and pulling off a yarn end that has run up onto the outer surface of the bobbin, an apparatus for forming a yarn reserve on a bobbin at a winding station, comprising a yarn guide element being disposed on the creel and movable toward and away from the bobbin for clasping the tube over a sector of at least 90° in the circumferential direction of the tube and winding the yarn end on the end of the tube to make a yarn reserve; the yarn guide element having a yarn guide surface to be placed against the end surface of the bobbin, the yarn guide surface having a yarn catching notch formed therein immediately adjacent the end surface of the bobbin; and an actuating element for actuating the yarn guide element.

The yarn guide device is mounted on the creel, so as to guide the yarn to be wound tightly against the end surface of the bobbin. While in normal winding operation the yarn guide device rests on the creel, but for winding the yarn reserve it is swiveled against the end surface of the bobbin in such a way that it comes to rest there. At the location where the yarn runs up on the tube when being wound on, the yarn guide element has a yarn catching notch, with which the yarn is guided as it is wound against the end surface of the yarn package. During the formation of the yarn reserve, the yarn is first pulled with tension out of the suction nozzle and wound onto the tube in several windings. Through the use of this yarn guide surface of the yarn guide element, the yarn is guided in such a way that it is deposited against the end surface of the yarn package on the tube. In this winding-up process, the yarn travels into the yarn catching notch. Once the yarn end is without tension and therefore is no longer held taut after leaving the suction nozzle, it is then guided by the notch. As a result, it is wound up completely. Due to the contact of the yarn guide surface on the end face of the yarn package, the yarn end is pressed in and is therefore well secured for transport by the friction of the yarn at the end surface. In accordance with another feature of the invention, the yarn guide element is adapted to the applicable contour of the end surface of the bobbin against which it can be made to rest. This adaptation is especially important for conical bobbins. Since the end surfaces of the bobbins as a rule are not planar, it is advantageous if the yarn guide surface of the yarn guide element is adapted to the end surface of the bobbin, so that there will be no clearance or gap between the yarn guide element and the end surface of the bobbin in which the yarn could move freely and without guidance. Depending on whether the yarn reserve is desired on one or the other end surface of the bobbin, the yarn guide element has a contour that is respectively shaped convexly or concavely.

In accordance with a concomitant feature of the invention, the yarn catching notch on the yarn guide element is disposed there at a point where the yarn guide element comes to rest in the region of the tube. A yarn catching notch disposed in this way securely guides the yarn in the region of the tube so that it can be wound onto it to make a yarn reserve, and the yarn end also comes to rest as much as possible in the region of the tube against the end surface of the yarn package. It can be more easily found then during further handling of the bobbins.

Other features which are considered as characteristic for the invention are set forth in the appended claims.

Although the invention is illustrated and described herein as embodied in an apparatus for forming a yarn reserve, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 1 is a fragmentary, diagrammatic, side-elevational view of a winding station of a textile machine that produces bobbins, with an apparatus according to the invention for forming a yarn reserve;

FIG. 5 is a cross-sectional view of a cylindrical bobbin with the associated yarn guide surface of a yarn guide element, which is taken along the line 5—5 of FIG. 3, in the direction of the arrows;

FIG. 6 is a view similar to FIG. 5 of a conical bobbin with the associated yarn guide surface of a yarn guide element for a first end face of the bobbin; and FIG. 7 is a view similar to FIGS. 5 and 6 of a conical bobbin with the associated yarn guide surface of a yarn guide element for a second end face of the bobbin.

Figure 2:
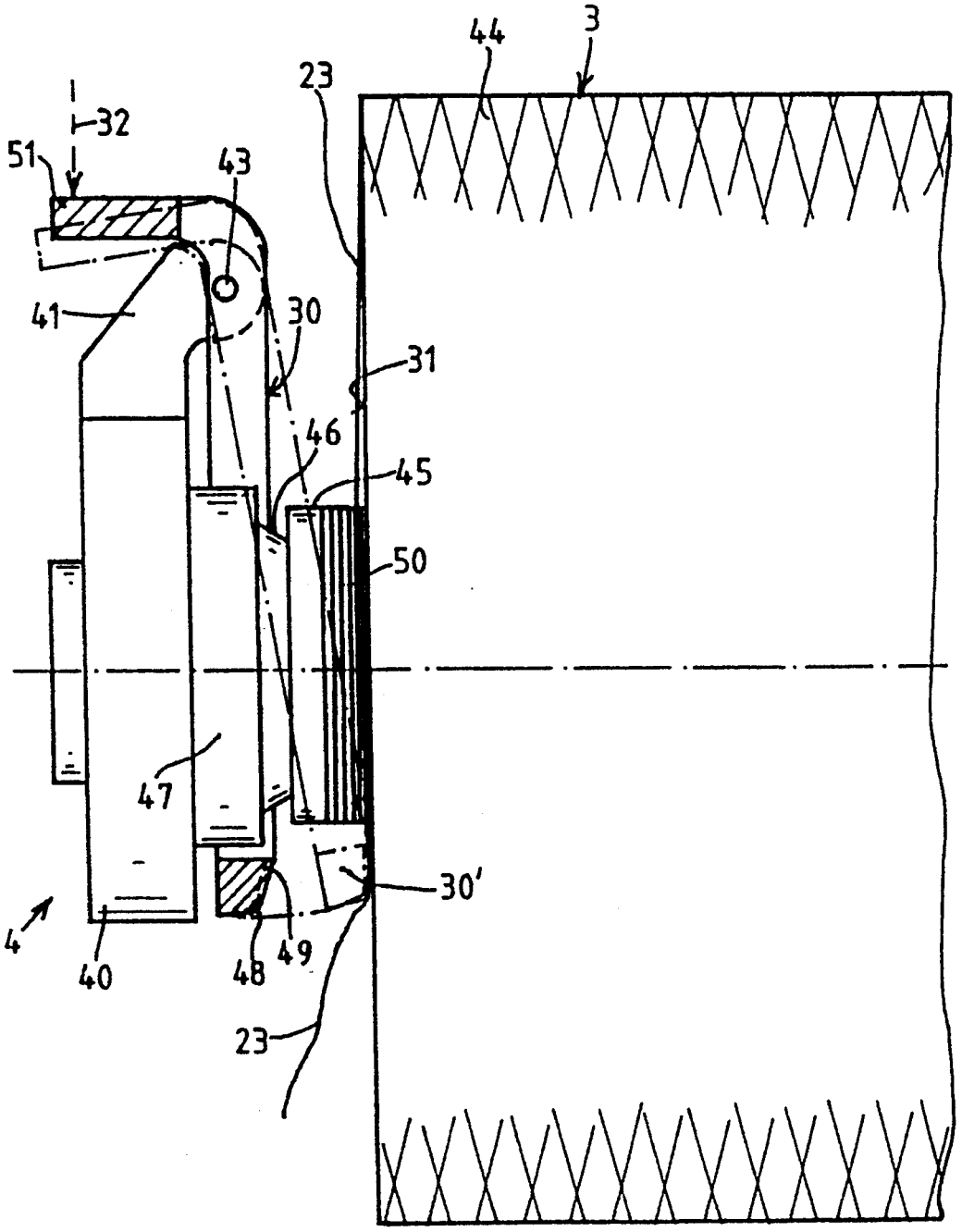
FIG. 2 is an enlarged, fragmentary, front-elevational view of the apparatus according to the invention.

Referring now to the figures of the drawing in detail and first, particularly, to FIG. 1 thereof, there is seen an exemplary embodiment of a textile machine 1 that produces bobbins and has a plurality of work stations 2 at which cross-wound bobbins or cheeses 3 are wound. Only one of the many work stations is shown in the side view of FIG. 1 and only those features contributing to a comprehension of the invention are shown and described in detail.

In the present exemplary embodiment, the bobbin has attained its intended yarn quantity. The bobbin 3, which is still rotatably held in a creel 4, has therefore been raised from a bobbin drive 5. The bobbin drive 5 includes a winding roller which drives the bobbin 3 by friction and is drivable by a shaft 6 that is guided longitudinally of the machine. The bobbin 3 is lifted from the winding roller of the bobbin drive 5 by a pneumatic lifting device 7, for example, which engages the creel 4. Upon actuation of the pneumatic lifting device 7, the creel swivels about a pivot shaft 8. In the process, the bobbin moves along a circular path 9 and is lifted from the winding roller 5.In that state, the delivery of yarn 10 from a yarn delivery point, such as a non-illustrated spinning station, is interrupted.

A bobbin changing carriage 11, serving as a movable servicing device, has positioned itself at the winding station 2. The bobbin changing carriage 11 has a bobbin changer and also carries with it a tube magazine 12 containing a supply of empty tubes 13. The bobbin changing carriage is supported by guide rollers 14 and 15 on rails 16 and 17 on the machine.

A yarn suction device, which is generally identified by reference numeral 18, is located on the bobbin changer carriage 11. The yarn suction device 18 includes a suction nozzle 19 of the kind which is known, for instance, from German Published, Non-Prosecuted Application DE 36 02 574 A, corresponding to U.S. Pat. No. 4,736,898. This suction nozzle serves to aspirate and pull off an end 23 of the yarn that has run up onto the surface of the bobbin. The suction nozzle 19 is pivotable about a pivot point 20, so that a suction opening 21 thereof, which moves along a circular path 22, can be positioned relative to the periphery of the bobbin 3. In the present exemplary embodiment of FIG. 1, the suction opening 21 has already been aimed at the periphery of the bobbin 3 and has aspirated the yarn end 23 that had run up onto the bobbin there.

In the position shown in FIG. 1, the yarn end 23 is just being wound onto a tube against the end face of the yarn package, to form a yarn reserve. In order to form the yarn reserve, the bobbin 3 is driven by an auxiliary drive 24. Through the use of a friction wheel that contacts the periphery of the bobbin and rotates in the direction of an arrow 25, the auxiliary drive 24 rotates the bobbin 3 in the direction of an arrow 26, which is the direction of rotation in which the yarn is wound up during bobbin winding. The auxiliary drive can be positioned along a circular path 29 of the bobbin 3 about a pivot point 28, by means of a holding device 27.

During the rotation of the bobbin, the apparatus according to the invention for forming the yarn reserve is in action. A yarn guide element 30 of the embodiment according to the invention rests against the end surface of the yarn package and guides the yarn end 23, which is pulled from the suction opening 21 across an end surface 31 of the bobbin 3. The yarn guide element 30 is pressed against the end surface 31 of the bobbin 3 by an actuating element 32. The actuating element 32 is pivotably supported at a pivot point 33 on the bobbin changing carriage 11 and for actuation it is swiveled out of a position of repose 32' along a path of motion 34, in the direction toward the yarn guide element 30.

Once the yarn reserve has been formed, the completely wound bobbin is lifted from the creel in a manner which is known and is described, for instance, in German Published, Non-Prosecuted Application DE 36 02 574 A, corresponding to U.S. Pat. No. 4,736,898, and placed on a conveyor belt 35 to be transported elsewhere. Subsequently, an empty tube 13 is taken from the tube magazine by means of a tube feeder 36. The tube feeder 36 has a tube gripper 37 which grasps an empty tube 13, rotates along a circular arc 38 about a pivot point 39, and places it into the opened creel 4. The tube is fastened in the creel, and the tube feeder 36 swivels back to its outset or initial position.

FIG. 2 shows the part of the creel on which the yarn guide element 30 is pivotably supported. The yarn guide element 30 is pivotably secured to a shaft 43 which passes through two hinges 41 and 42, that are both seen in FIG. 3. The hinges 41 and 42 are located on one of two holder arms, specifically on a holder arm 40, of the creel 4.

Figure 4:
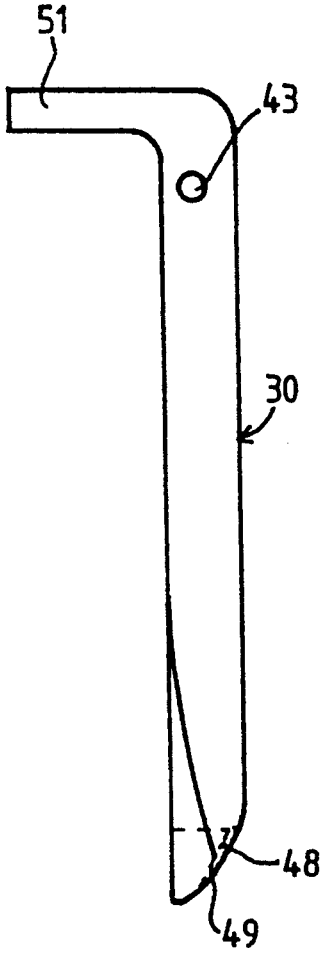
FIG. 4 is a front-elevational view of the yarn guide element of FIG. 3.
Figure 3:
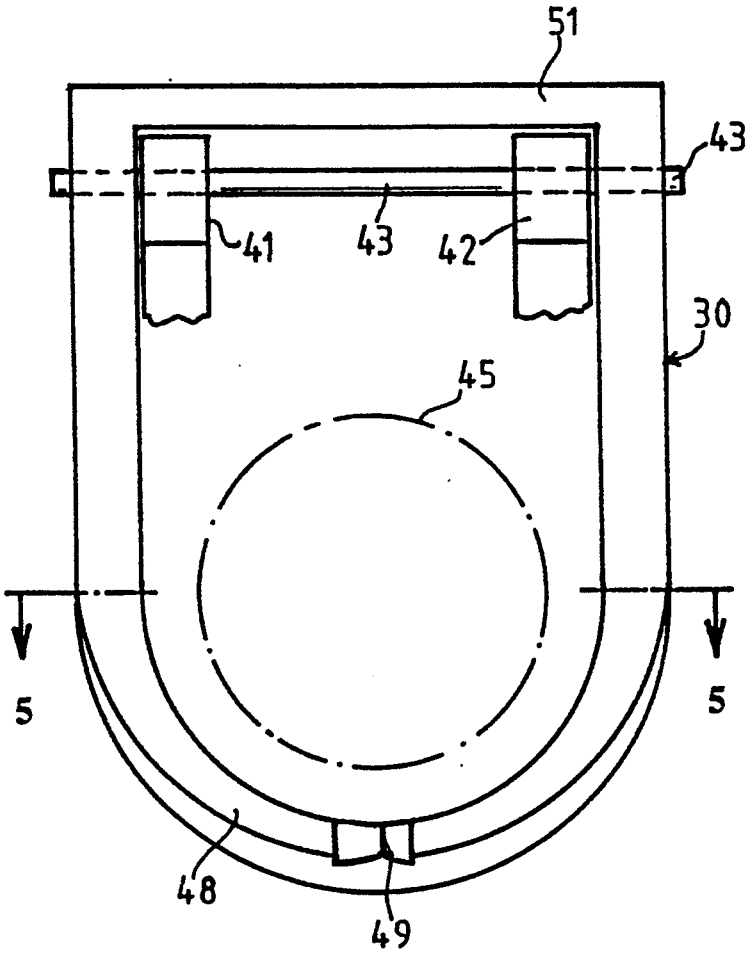
FIG. 3 is a fragmentary, side-elevational view of a yarn guide element of the apparatus.

The bobbin 3 includes a yarn package 44 and a tube 45, one end of which protrudes from the end surface 31 of the yarn package. This end of the tube is retained by a tube platform 46, which is rotatably supported in a bearing 47 in the holder arm 40 of the creel 4. In the position of repose, the yarn guide element 30 rests parallel to the holder arm 40 and therefore parallel to the end surface 31 of the yarn package. It can be held in this position by means of a non-illustrated spring or by gravity. FIGS. 3 and 4 show one embodiment of the yarn guide element. The yarn guide element has a flat contour and clasps, fits around or embraces the tube on its periphery. In the present case, the yarn guide element 30 clasps the tube 45 over 180°. However, it is also conceivable for the yarn guide element 30 to clasp the tube 45 over approximately 90° in the region of the yarn travel, that is in an embodiment with a one-quarter segment. In the region in which the yarn guide element 30 comes to rest against the end surface 31 in the vicinity of the tube 45 of the bobbin 3, the yarn guide element 30 includes a yarn guide surface 48, which conforms to the end surface 31 of the yarn package. A yarn catching notch 49 is located at a point where the yarn guide surface 48 comes to rest against the end surface of the yarn package. This yarn catching notch 49 is cut in such a way that it catches the yarn end 23 traveling from the tube 45 to the suction nozzle 21, and causes it to rest against the end surface 31 of the yarn package.

As can be seen from FIG. 2, this end yarn 23 is first wound onto the end of the tube 45, making a yarn reserve 50, before the end 23 of the yarn emerging from the suction nozzle 19 is made to rest against the end surface 31 of the yarn package by the yarn guide element 30. Since the end 23 of the yarn pulled out of the suction opening 21 is no longer under tension, the danger exists that it will be spun loosely around the tube without the yarn guide element 30. The yarn guide element 30, with its yarn catching notch 49, engages the slack yarn end 23, as can be seen in FIG. 2, and first brings about a further winding up of the yarn end onto the tube and then presses the end of the yarn against the end surface 31 of the yarn package with the aid of the yarn guide surface 48.

In order to enable the yarn guide surface 48 of the yarn guide element 30 to be brought into contact with the end surface 31 of the yarn package, it has a bent strap 51 that acts as a lever arm and is located above the pivot point about the shaft 43. This strap 51 is bent at a right angle away from the base body of the yarn guide element. If the actuation element 32, which is represented by an arrow drawn in broken lines in FIG. 2, acts upon the strap 51, then the yarn guide element 30 is swiveled out of its position of repose into a position 30' and comes to rest with its yarn guide surface 48 against the end surface 31 of the yarn package. Alternatively, the actuation of the yarn guide element may be carried out by means of the pressing lever of the bobbin changer.

FIGS. 5, 6 and 7 show possible embodiments of the yarn guide surface 48 of the yarn guide elements to fit the various possible embodiments of the end surfaces of the yarn packages.

FIG. 5 shows a cylindrical bobbin of the kind which is also shown in FIG. 2. The yarn guide surface 48 of the yarn guide element 30, which is shown in a section as indicated in FIG. 3, has a course that is located in a bearing surface which is parallel to the end surface 31 of the yarn package. If the bobbin 3 rotates in the winding direction 26, then the yarn guide element is pressed against the end surface 31 of the yarn package in the direction of an arrow 52 and catches the yarn 23 with the yarn catching notch 49 and presses it against the end surface 31 of the yarn package.

FIGS. 6 and 7 each show a respective conical yarn package 53 and 54. An end surface 55 of the yarn package at the tip of a conical bobbin tube 56 is concavely retracted, so that a correspondingly formed yarn guide surface **48*a* of a yarn guide element 30*a* comes to rest against the end surface 55. The contour of the yarn guide surface 48*a* is constructed to match the end surface contour 55. If the yarn guide surface 48*a* of the yarn guide element 30*a* is pressed in the direction of an arrow 57 against the bobbin rotating in the direction of an arrow 58, a free end 23*a* of the end of the yarn is grasped by a yarn catching notch 49*a* and made to rest against the end surface 55 of the yarn package 53** and be fixed there.

If a yarn reserve on an end surface 60 at the base of the conical yarn package 54 is to be wound onto the thick end of a conical tube 59, then a concave contour of a yarn guide surface **48*b* of a yarn guide element 30*b* comes to rest on that end surface. The concave contour of the yarn guide surface 48*b* of the yarn guide element 30*b* is optimally adapted to the contour of the end surface 60 of the conical yarn package 54. If the yarn guide element 30b is moved in a direction of motion 61 toward the end surface 60 of the yarn package 54, which is moving in a winding direction 62, then a yarn end 23*b* is grasped by a yarn catching notch 49*b*, swiveled against the end surface 60** and there made to rest in a fixed manner, where it sticks to the yarn layers on the end surface by friction.

I claim:

1. In a textile machine producing cross-wound bobbins, including a number of work stations having a creel with a bobbin changing position and means for holding a bobbin, the bobbin comprising a tube having an end and a yarn package formed on the tube, the yarn package having an outer surface and an end face, and a movable servicing device serving the work stations for changing takeup bobbins and having a drive apparatus for a bobbin in the changing position and a yarn suction device for seeking, aspirating and pulling off a yarn end that has run up onto the outer surface of the bobbin, an apparatus for forming a yarn reserve on a bobbin at a winding station, comprising:

a yarn guide element disposed on the creel and movable toward and away from the bobbin for clasping the tube over a sector of at least 90° in the circumferential direction of the tube and winding the yarn end on the end of the tube to make a yarn reserve;

said yarn guide element having a yarn guide surface to be placed against the end face of the yarn package, said yarn guide surface having a yarn catching notch formed therein immediately adjacent the end face of the yarn package; and an actuating element for moving said yarn guide element toward and away from the bobbin so as to deposit the yarn end against the end face of the yarn package.

2. The apparatus according to claim 1, wherein said yarn guide element has a shape adapted to a contour of the end face of the yarn package against which it is to be placed.

3. The apparatus according to claim 1, wherein said yarn guide element comes to rest at a given point in the vicinity of the tube, and said yarn catching notch is disposed at said given point.

* * * * *